US009161120B2

(12) United States Patent
Beardsley

(10) Patent No.: US 9,161,120 B2
(45) Date of Patent: Oct. 13, 2015

(54) OPEN-BAFFLE LOUDSPEAKER

(75) Inventor: Stephen A. Beardsley, Leeds (GB)

(73) Assignee: SOUND-WING TECHNOLOGIES LTD, Leeds (GB)

( * ) Notice: Subject to any disclaimer, the term of this patent is extended or adjusted under 35 U.S.C. 154(b) by 0 days.

(21) Appl. No.: 13/578,479

(22) PCT Filed: Feb. 11, 2011

(86) PCT No.: PCT/GB2011/050252

§ 371 (c)(1),
(2), (4) Date: Sep. 10, 2012

(87) PCT Pub. No.: WO2011/098822

PCT Pub. Date: Aug. 18, 2011

(65) Prior Publication Data

US 2013/0004007 A1 Jan. 3, 2013

(30) Foreign Application Priority Data

Feb. 12, 2010 (GB) ..... 1002439.6

(51) Int. Cl.

| | |
|---|---|
| ***H04R 25/00*** | (2006.01) |
| ***H04R 1/34*** | (2006.01) |
| ***H04R 1/24*** | (2006.01) |
| *H04R 7/04* | (2006.01) |
| *H04R 9/06* | (2006.01) |

(52) U.S. Cl.

CPC ..... *H04R 1/347* (2013.01); *H04R 1/24* (2013.01); *H04R 7/045* (2013.01); *H04R 9/063* (2013.01); *H04R 2209/027* (2013.01); *H04R 2440/07* (2013.01)

(58) Field of Classification Search

USPC ..... 381/182

See application file for complete search history.

(56) References Cited

U.S. PATENT DOCUMENTS 3,953,675 A * 4/1976 Babb ..... 381/353

OTHER PUBLICATIONS

"Super V", GR research, Dec. 2007, http://gr-research.com/super-v.aspx.*

GR-Research, The Super-V, Printout from Internet: http://www.gr-research.com/index.asp?PageAction=VIEWPROD&ProdID=158.

GR-Research, technical drawings, Super-F, Printout from Internet: http://www.gr-research.com/pdf/supervbox.pdf.

Stone, Steven: Steven Stone's Best of RMAF 2009; Printout from Internet: http://www.avguide.com/blog/steven-stones-best-rmaf-2009.

Martin Colloms: "High Performance Loudspeakers", Feb. 1, 2000, John Wiley & Sons, Ltd. Chichester, p. 352.

Linkwitz et al. "Room Reflections Misunderstood?"; AES Convention 123rd; Oct. 2007, Audio Engineering Society.

* cited by examiner

*Primary Examiner* — Davetta W Goins
*Assistant Examiner* — Amir Etesam
(74) *Attorney, Agent, or Firm* — Gable&Gotwals

(57) ABSTRACT

The invention relates to a loudspeaker which includes one or more drivers, a front panel and a further panel extending rearwardly therefrom. The rearwardly extending panel is typically offset towards one side of the front panel and includes an outer edge with at least portion which is curved. The provision of the arrangement of the said panels provides significant improvement in terms of the sound quality which can be achieved from the loudspeaker.

19 Claims, 9 Drawing Sheets

OPEN-BAFFLE LOUDSPEAKER

CROSS-REFERENCE TO RELATED APPLICATIONS

This application is the United States National Phase of PCT Patent Application No. GB2011/050252 filed 11 Feb. 2011, which claims priority to Great Britain Application No. 1002439.6 filed 12 Feb. 2010, which are incorporated herein by reference.

BACKGROUND OF THE INVENTION

The invention to which this application relates is a loudspeaker.

It is well known to provide a loudspeaker in which an electromagnetic driver is moved back and forth to produce sound waves. The driver is typically mounted in an enclosure, which helps prevent the sound waves produced from the back of the driver from interfering with those produced from the front thereof.

The simplest type of driver mount is a flat panel with holes cut into it for the drivers. However, frequencies with a wavelength greater than the dimensions of the panel are still affected because the antiphase sound waves from the back of the driver interfere with those from the front.

In addition, the shape of the enclosure can diffract the sound waves, particularly where the higher frequencies have wavelengths similar to or smaller than the dimensions of the enclosure or sharp edges are encountered.

Diffraction can therefore change the sound from its original quality, causing peaks and troughs in the frequency response. Such degradation in sound quality is obviously undesirable for the user, and so manufacturers often use electronic systems to compensate for the diffraction.

Nevertheless, it is difficult to fully compensate for diffraction across the full range of audible sound, as compensated sound still has to travel past both external and internal corners of the enclosure, which causes time-delayed bleed through the driver cones from internal diffraction and phase-shifts from exterior cabinet corners as external diffraction.

A further type of loudspeaker is the electrostatic loudspeaker, in which a membrane is suspended in an electrostatic field, which is varied to move the membrane thereby generating sound waves. The structural design of electrostatic loudspeakers, which are generally dipole by design, allows them to be flatter than those containing conventional drivers, but a disadvantage is that the lack of enclosure, and the large size of the electrostatic membrane necessary for the generation of bass frequencies, engenders a limited off-axis frequency response.

An aim of the present invention is to provide a loudspeaker with high sound quality that overcomes at least some of the above issues.

According to an aspect of the invention, there is provided a loudspeaker comprising:

- a front panel;
- one or more drivers;
- a panel extending rearwardly from the front panel;
- characterised in that said rearwardly-extending panel has an outside edge, of which at least a portion is curved.

Typically the rearwardly-extending panel is offset towards one side of the front panel and in one embodiment extends from an edge of the front panel.

Typically substantially the whole of the outside edge of the rearwardly extending panel is curved.

In one embodiment the outside edge defines a substantially constantly changing radius of the rearwardly extending panel.

Typically the rearwardly extending panel is shaped as a portion of an ellipse or an oval. In one embodiment the portion is defined by two chords, typically at the intersection there between.

Advantageously, the shape of the rearwardly extending panel, which can also be referred to as a side panel or wing, and its arrangement, which is perpendicular to the front baffle and preferably set at an inclined angle of 7°, makes use of boundary reflection and the consequent phase change arising from when a sound-wave encounters a hard boundary, i.e. the boundary's displacement remains zero and the reflected wave changes its polarity (undergoes an 180° phase change). Therefore, that part of the wave that is reflected is now in phase with that from the front; which noticeably results, when say a 50 Hz wave is reflected, in a more substantial bass response. This particular characteristic of the rearwardly extending panel can be referred to as a Positive Phase Transformer (P.P.T.); which is quite unlike the conventional dipole characteristic, where the positive and negative phases meet and cancel to the detriment of the overall bass response.

In one embodiment of the invention the rearwardly extending panel provides a polar response with cardioid-like characteristics in a forward axis, and a combination of sub-cardioid (as a result of P.P.T.) and dipole polar response in a rearward axis. With the deepest null occurring at the rearwardly extending panel's edge; so the combination of polar patterns provides a complex pseudo-hypercardioid response at above or around 250 Hz and a sub-cardioid/dipole response below or around 250 Hz. As such, frequencies above ~250 Hz have a much more uniform polar response than is conventionally achieved, and there are therefore substantially fewer fluctuations in sound in locations around the speaker.

As to those frequencies which are below ~250 Hz, and as a result of the phase change characteristics of the rearwardly extending panel or wing (P.P.T) and in accordance with the invention, there is a reduction in the typical effects of bass cancellation resulting from a conventional dipole design. In practice it is found that those frequencies below 35 Hz, and in a suitably proportioned room, increasingly follow a more dipole-like characteristic; that is, the positive and negative phases meet and cancel out one another, leading to a consequent drop in sensitivity at sub-bass frequencies.

The rearwardly extending panel mitigates diffraction step loss, substantially preventing the formation of peaks and troughs in the frequency response as the constantly changing radius of the edge of the panel means that there are no significant regions along the edge thereof wherein diffraction of a particular wavelength is concentrated. The frequency response closely mimics that of the perfect sphere, as determined by Dr Olsen in the 1930's, wherein under anechoic room conditions the bass rolls off gently at around 6 dB-per-octave, without any peaks or troughs in the frequency response.

In contrast, a conventional enclosure is provided with a rear panel at a constant distance from the front panel, which defines a dimension wherein wavelengths similar or smaller thereto may cause significant diffraction in the corresponding range compared to other frequencies, thereby leading to peaks and troughs in the overall frequency response. In such enclosures the sound appears to emanate predominantly from the front thereof.

In one embodiment the provision of the rearwardly extending panel, and its defined shape, aids the detachment of a launched sound wave such that there are no significant or large drops in sound in locations around the speaker i.e. the polar response is substantially uniform as the sound wave smoothly leaves the rearwardly extending panel. This can be referred to as Enhanced Wave-launch Technology (E.W.T.)

Typically the rearwardly extending panel extends from the front panel at approximately right angles thereto.

In one embodiment the rearwardly extending panel is provided with ribs. In one embodiment the rear face of the front panel is also provided with ribs.

Typically the ribs substantially traverse the surface of the front and/or rearwardly extending panel in a non-uniformly spaced arrangement.

Typically the ribs are positioned on the rearwardly extending panel at different angles to each other, and may be straight or curved.

The ribs aid in the reduction of induced panel resonances therein. In addition they reduce the pressure drag, in an analogous manner to vortex generators utilised in aerofoil design, which create vortices for putting energy back into the flow of the boundary layer.

In one embodiment the rearwardly extending panel is provided with one or more channels between the ribs. Typically the channels extend linearly in a divergent fashion. Typically the channels are U-shaped or V-shaped.

In one embodiment the rearwardly extending panel is provided with a pattern of shapes arranged substantially across the surface of the panel, and/or at a substantially constant distance from the curved edge. Typically the shapes are arranged in an undulating formation.

Typically the shapes are recesses or protrusions having a depth of around 0.5-2.0 mm.

In one embodiment the shapes are denticular. Typically the denticular shapes are provided with longitudinal ridges, the shapes being arranged such that the ridges form a pattern of divergent lines.

In one embodiment the shapes are embossed onto sheets of material such as leather, which sheets are adhered to the side panel.

The shapes generate vortices to help prevent premature detachment of air flow and thus the sound wave from the surface, particularly the panel edge where the most turbulence is found. These forms of air flow manipulations can be referred to as Denticular Assisted Wave-launch Technologies (D.A.W.T).

In one embodiment the panels are made of a sheet material such as plywood. Typically the panels are made of a substantially void-free sheet material such as a beech or maple. These materials provide a superior impulse response.

Typically the loudspeaker drivers are mounted in the front panel.

In one embodiment the front panel is provided with two drivers each corresponding to different frequency ranges.

In one embodiment the front panel is trapezoid. In a further embodiment the front panel is substantially triangular. Typically the front panel is asymmetric.

In one embodiment the edge of the front panel defines a substantially constantly changing radius.

In one embodiment the front panel is shaped as a portion of an ellipse or an oval. Typically the portion is defined by two chords.

In one embodiment the front panel is inclined inwardly at around 5 degrees in order to time align the drivers. The top of the loudspeaker is thus inset compared to the bottom.

In one embodiment the angle between at least one of the side edges of the front panel and the lower edge is around 83 degrees. Thus the top of the loudspeaker is narrower than the bottom, and the rearwardly extending panel is inclined by around 7 degrees.

In one embodiment crossover components are provided on isolation mounts.

According to a further aspect of the invention, there is provided a loudspeaker comprising:

a front panel;

one or more drivers mounted in the front panel;

a panel extending rearwardly from the front panel;

characterised in that the rearwardly extending panel has a curved outside edge defining a substantially constantly changing radius.

Specific embodiments of the invention are now described wherein:—

FIG. 5 illustrates (a) a rearwardly extending panel according to a further embodiment of the invention, wherein sheets of leather are embossed with a denticle pattern, and (b) the denticles are arranged in divergent lines; (c) denticle plan view; (d) denticle side view; (e) denticle cross-sectional view; and FIG. 6 illustrates a front view of a loudspeaker according to a further embodiment of the invention.

With reference to FIGS. 1*a-d*, there is illustrated a loudspeaker 2 comprising a front panel 4 provided with an upper aperture 6 and a lower aperture 8 for receiving loudspeaker drivers corresponding to high and low frequency ranges respectively.

Figure 1A:
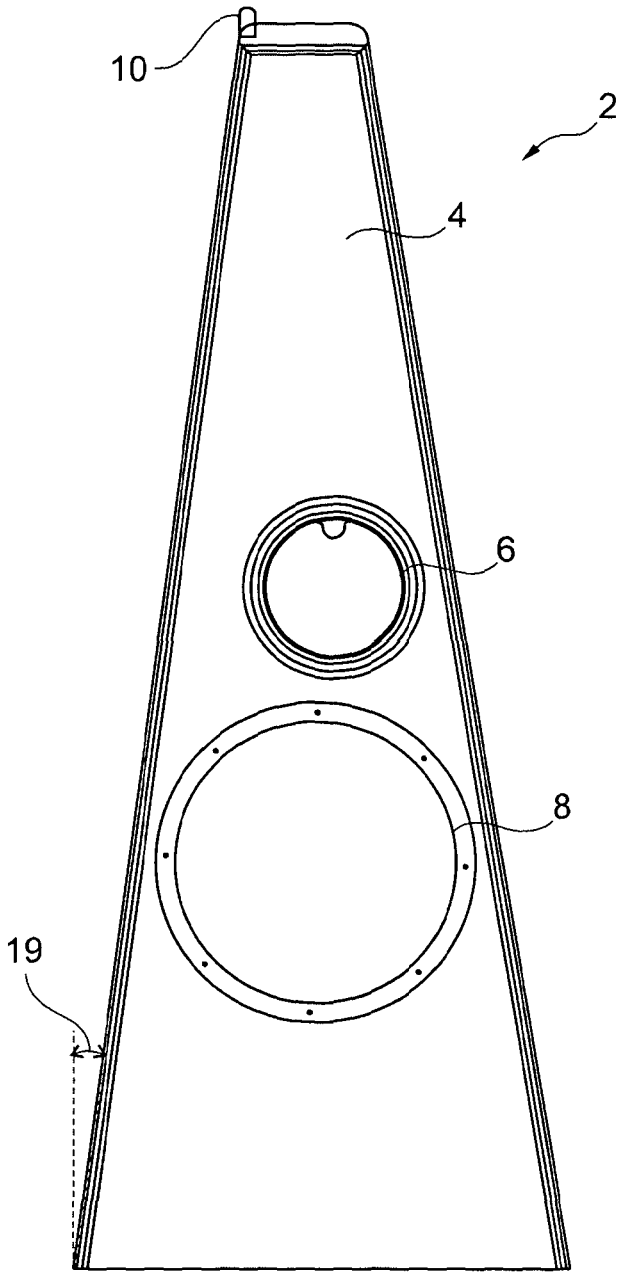
FIG. 1 illustrates views of a loudspeaker according to an embodiment of the invention: (a) front; (b) side interior; (c) side-rear interior; and (d) top.

The front panel may be trapezoid as illustrated in FIG. 1*a*, with the following dimensions: top edge 150 mm; bottom edge 610 mm; left edge 1540 mm; right edge 1555 mm.

The front panel may be inclined at an angle of 85 degrees from horizontal for the purpose of time alignment of the two drivers' acoustic centres, resulting in a height of 1535 mm.

Figure 1B:
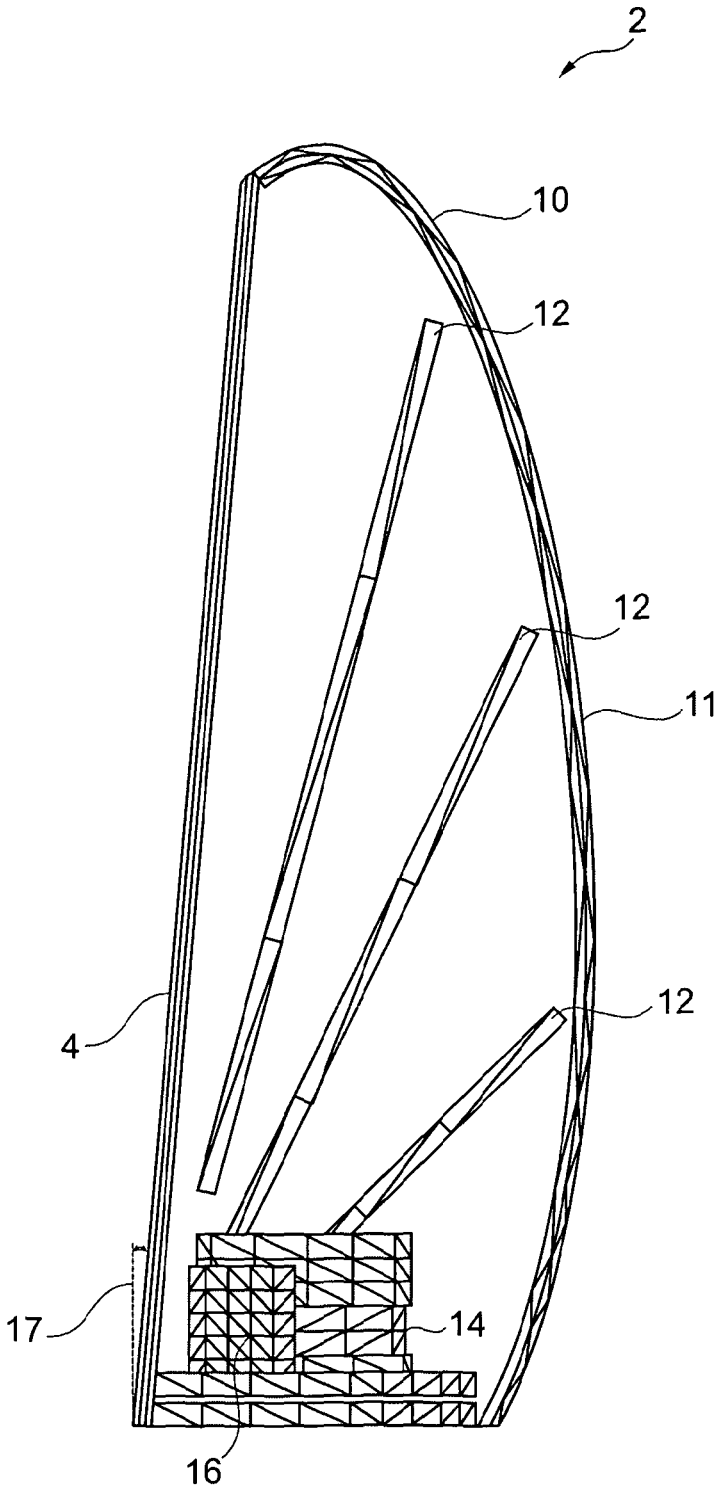
Figure 1C:
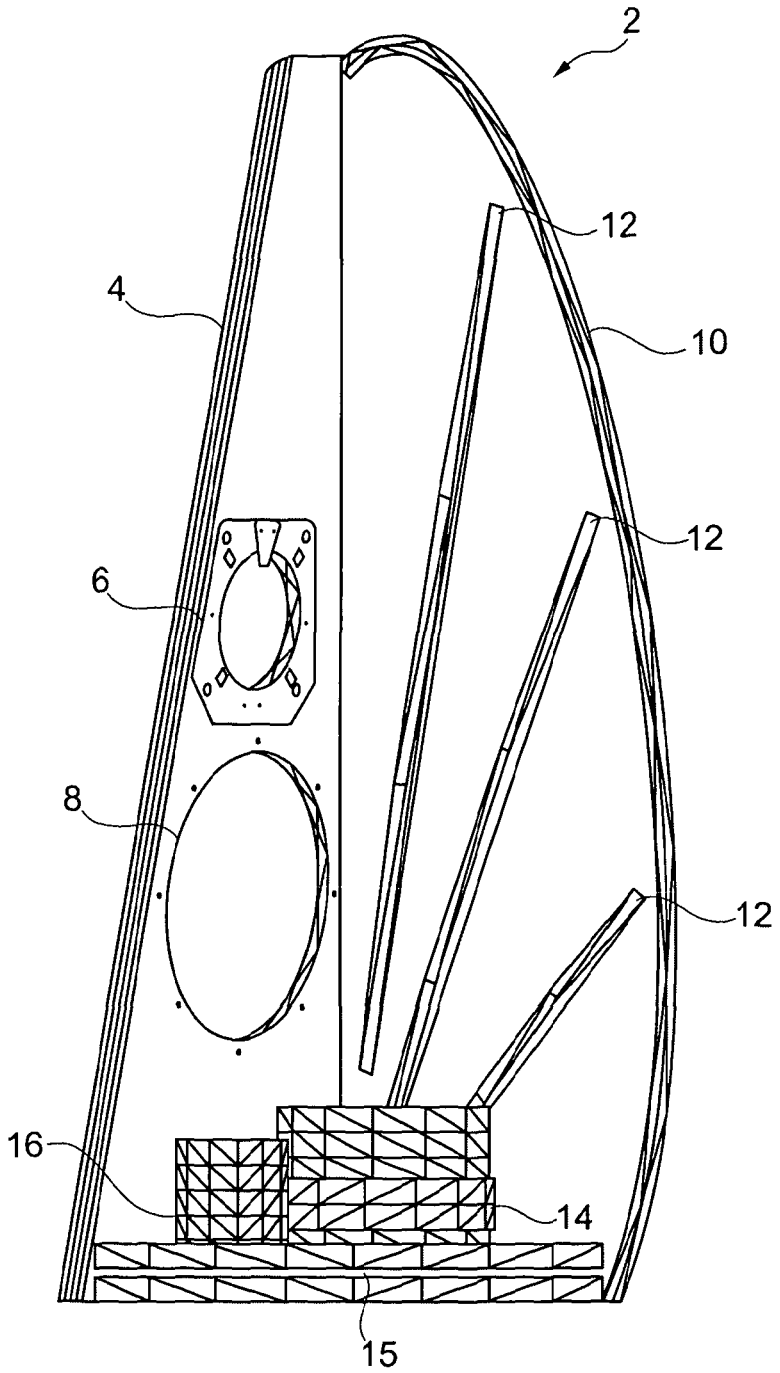

As shown in FIGS. 1*a* and 1*b* a rearwardly extending panel 10 extends rearwardly at a right angle from the front panel and is typically offset to one side of the front panel and yet further can be located at one edge of the front panel. The rearwardly extending panel 10 has a curved outside edge 11 which defines a substantially constantly changing radius. This helps prevent the formation of peaks and troughs in the frequency response that may otherwise form if a significant portion of the edge was at a constant distance from the drivers in the front panel, as tends to be found with faces of a conventional rectangular cuboid enclosures.

The front panel may also have a curved edge for similar reasons, such as that illustrated in FIG. 6 wherein the front panel 4' is substantially triangular and the right hand edge 46 has a substantially constantly changing radius.

The rearwardly extending panel may have the following dimensions: long straight side edge 1520 mm; short straight bottom edge 440 mm; maximum radius (i.e. distance between intersection of straight edges and curved edge) 510 mm.

The rearwardly extending panel 10 is, in the embodiment shown, provided with three spaced ribs 12 extending thereacross at different angles to each other. The ribs allow for the reduction and even distribution of induced panel resonances, thereby avoiding large resonant peaks, therein which may otherwise distort the sound.

Crossover components 14, 16 on isolation mounts are also provided in the base 15 of the loudspeaker to separate out the high and low frequencies from the source for reproduction by the respective drivers.

The crossover components may include a $1^{st}$ Order Butterworth alignment, with a crossover point of 295 Hz. This is linear phase and provides a superior impulse response, when compared to $2^{nd}$, $3^{rd}$ and $4^{th}$ Order crossover alignments.

A single inductor may be used for the bass leg, and a single capacitor for the tweeter leg. The product may incorporate drivers in the form of a Manger 8" full range driver and an Acoustic Elegance 15" bass driver.

Isolation mounts have been applied to three aspects of the design:

a) Full range driver mounting. This decouples the 'full-range driver' from the negative effects of unwanted vibration from the bass driver.

b) Isolation of the 'spiked' base 15 from the front panel 4, side panel 10 and sub-base assembly; effectively isolating the loudspeaker from transmitting vibration to the floor on which the base is positioned and thereby inhibiting subsequent floor interaction.

c) Isolation of the crossover boxes 'cylinders' from the front panel 4, side panel 10 and sub-base assembly. This last method of decoupling, isolates the crossover components, capacitor and inductor (these are potentially microphonic) from outside vibrations.

Figure 1D:
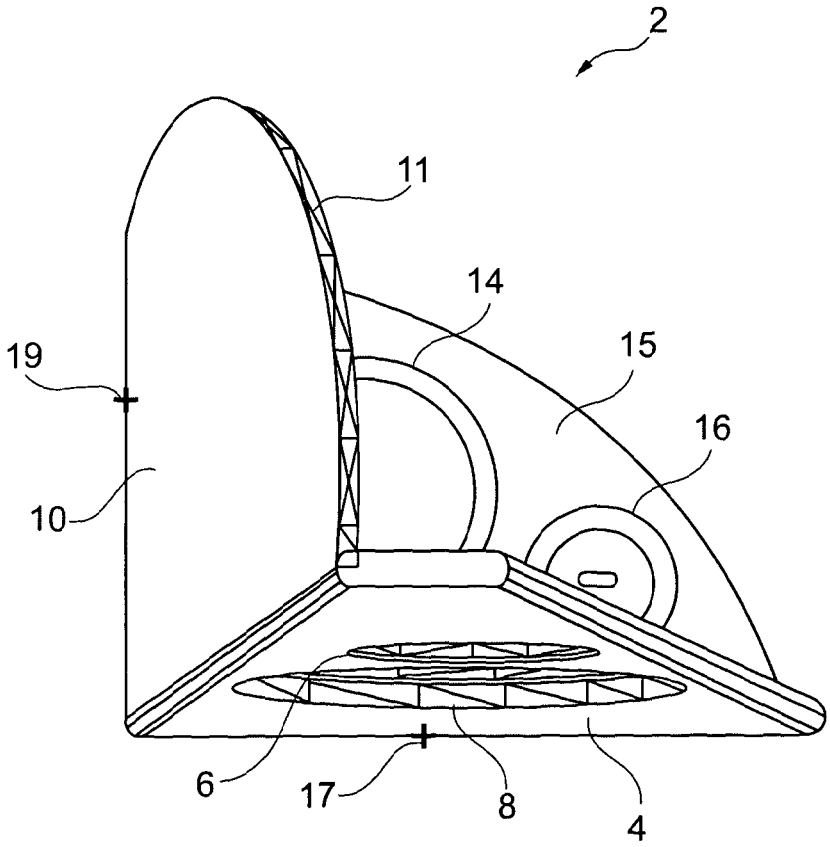

When viewed from above as shown in FIG. 1*d*, it can be seen that the front 4 and rearwardly extending 10 panels are inclined inwardly by a small angle with respect to the vertical planes 17, 19 respectively and in one embodiment the angle is 5 degrees for the front panel 4 and 7 degrees for the rearwardly extending panel 10 from the base to the top and with respect to the vertical axis, and this feature helps time align the drivers.

Figure 2A:
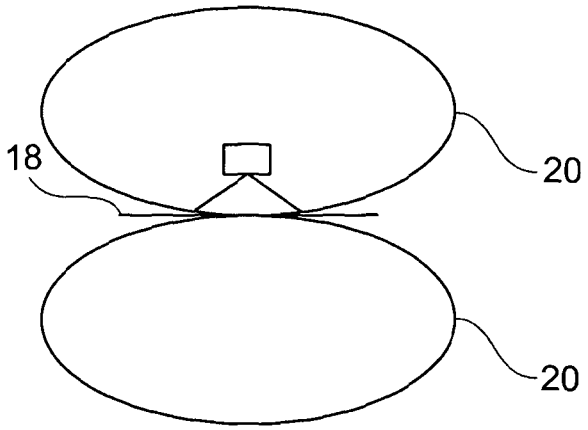
FIG. 2 illustrates (a) a dipole polar response as may be provided by a known speaker and (b) the pseudo-hypercardioid response provided by the invention.
Figure 2B:
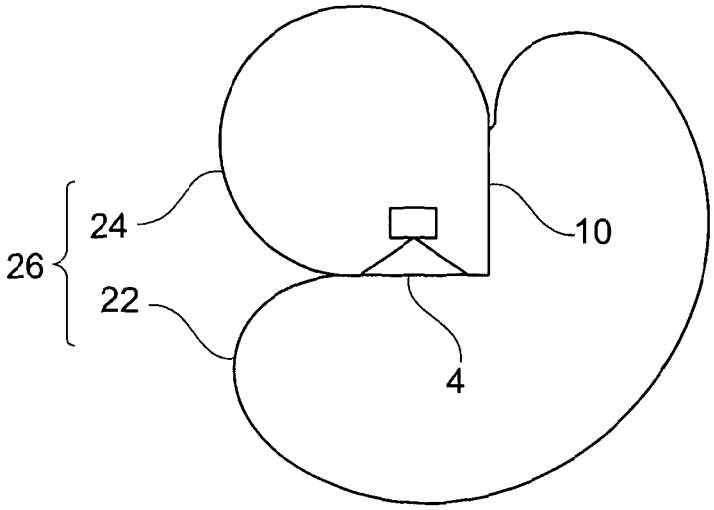

As illustrated in FIG. 2*a*, the polar response of a conventional speaker 18 is dipole 20, in contrast to that of the speaker of the invention shown in FIG. 2*b*, wherein the defined shape of the rearwardly extending panel 10, and its arrangement, provides a polar response with cardioid-like characteristics 22 in a forward axis, and a sub-cardioid/dipole response 24 in a rearward axis, such that the combination of the two polar patterns provides a pseudo-hypercardioid response 26.

Figure 3A:
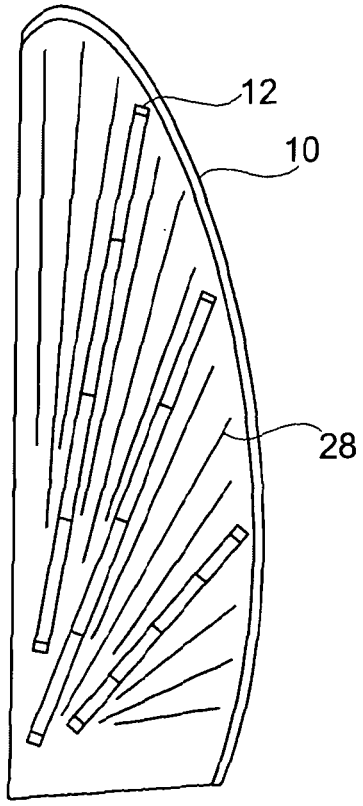
FIG. 3 illustrates (a) a rearwardly extending panel with channels according to a further embodiment of the invention, where the channels are (b) V-shaped or (c) U-shaped.

FIG. 3*a* illustrates a further embodiment of the rearwardly extending panel 10 of the invention wherein divergent linear channels 28 are formed between the ribs 12 of the rearwardly extending panel 10, which help reduce pressure drag across the back face of the side panel.

Figure 3B:
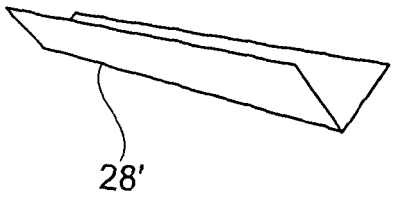
Figure 3C:
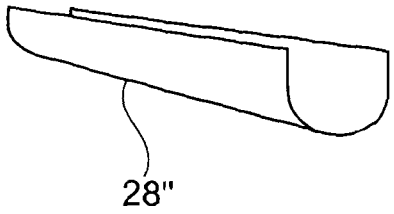

These channels could be V-shaped 28' or U-shaped 28", as respectively illustrated in FIGS. 3*b*-*c*. The channels can be machined into the panel with a width of around width 3.175 mm and depth of around 1.5-2.0 mm. The removed material would thereby leave ridges across the surface area of the panel. The edges of each machined channel, nearest the constantly changing radius, would form the basis of a 'clam-shell' undulating pattern.

Figure 4A:
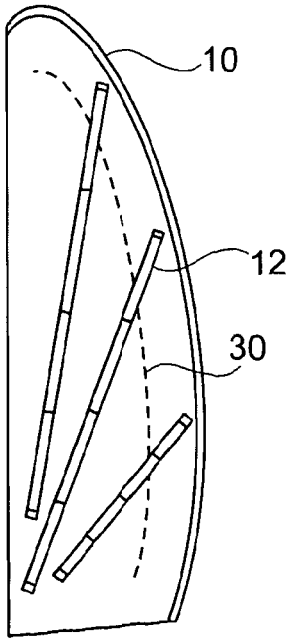
FIG. 4 illustrates (a) a rearwardly extending panel with a pattern according to a further embodiment of the invention, wherein the pattern comprises (b) dimples; (c) slots; or (d) denticles.

FIG. 4*a* illustrates a further embodiment of the rearwardly extending panel of the invention wherein a pattern extends across a portion 21 of the panel with the pattern portion at a constant distance of 153 mm from the curved edge, as indicated by dashed line 30. In each case the pattern's shapes generate vortices to help prevent premature detachment of air flow and thus the sound wave from the surface, particularly the panel edge 11 where the most turbulence is found.

Figure 4B:
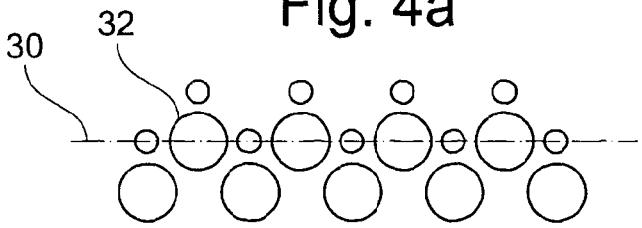

The pattern may be in the form of dimples in the form of large and small shallow holes having respective diameters of around 6.35 mm and around 3.175 mm as illustrated in FIG. 4*b*. The depth of these holes is around 1.5-2.0 mm, with a V or U shaped cross-section.

Figure 4C:
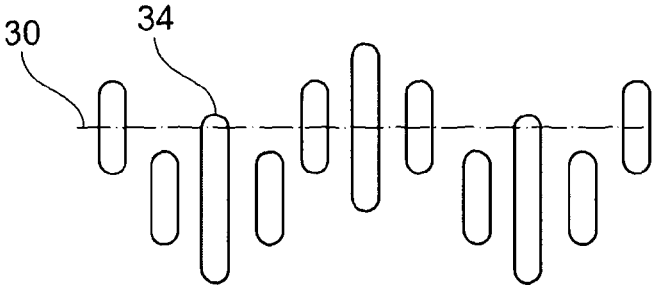

Alternatively, as illustrated in FIG. 4*c*, a slotted pattern may be routed into the surface of the side panel to a depth of around 1.5-2.0 mm, the slots having alternating lengths of around 8.0 or 15.0 mm and a width of around 3.175 mm.

Figure 4D:
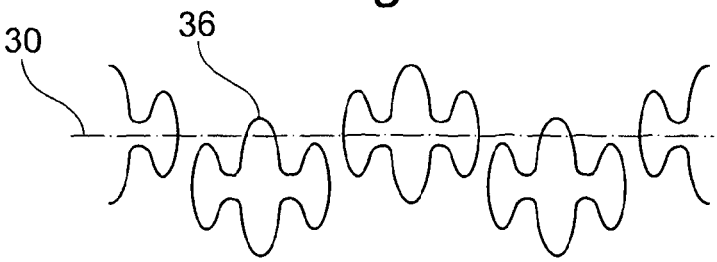

A further alternative is to provide denticle-shaped veneers, having a depth of 0.5 mm-0 mm, which may be attached to the surface of the rearwardly extending panel with adhesive, as illustrated in FIG. 4*d*.

Figure 5A:
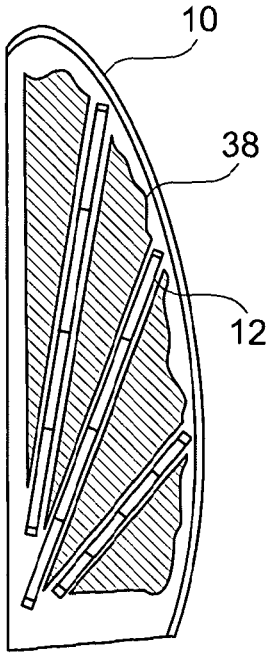
Figure 6:
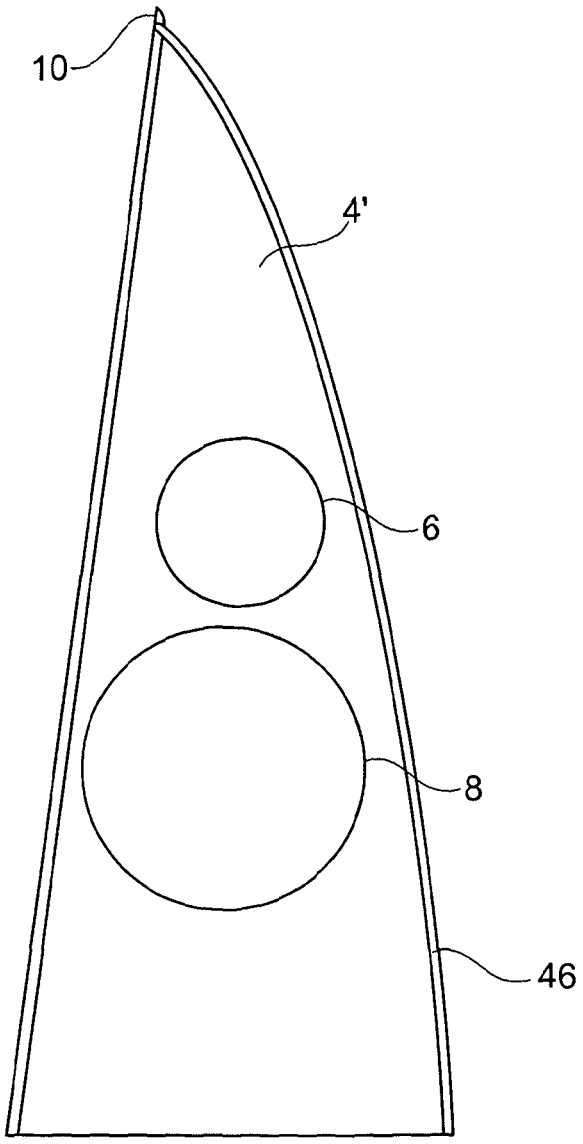

FIG. 5*a* illustrates a further embodiment of the rearwardly extending panel 10 of the invention wherein sheets of material, in this case, leather 38 are applied to the rear of the rearwardly extending panel 10, the leather sheets being embossed with a denticle pattern, which is anatomically analogous to those found naturally, such as a sharks skin.

Figure 5B:
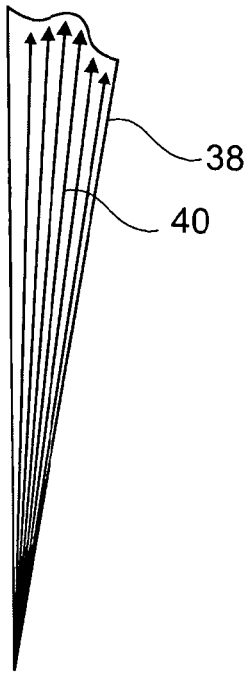
Figure 5C:
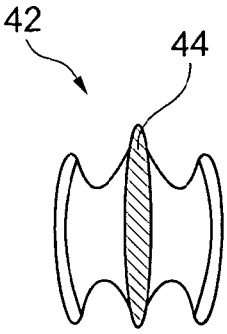
Figure 5D:
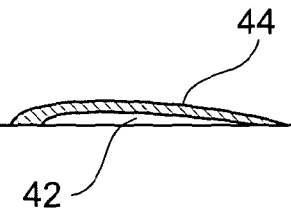
Figure 5E:
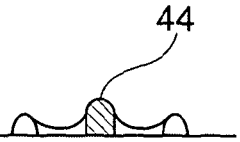

As illustrated in FIGS. 5*c*-*e*, the denticles 42 are provided with ridges 44. The shapes are arranged such that the ridges 38 form a pattern of divergent lines 40, as illustrated in FIG. 5*b*, and help reduce pressure drag, akin to the channels described in FIGS. 3*a*-*b*.

Thus in use, the loudspeaker produces a sound with a more uniform polar response, as the rearwardly extending panel assists the smooth detachment of the launched sound wave; and mitigates diffraction step loss.

The effect is that the sound quality is higher than a conventional loudspeaker, resulting in a more uniform off-axis reproduction across different locations.

It will be appreciated by persons skilled in the art that the present invention may also include further additional modifications made to the device which does not affect the overall functioning of the device.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is limited only by the scope of the attached claims, including the full range of equivalency to which each element thereof is entitled.

The invention claimed is:

1. An open baffle loudspeaker, said loudspeaker comprising:

a front panel;

one or more drivers mounted in said front panel; and a single panel extending rearwardly from the front panel, said rearwardly-extending panel having an outside edge of which at least a portion is curved such that a portion of the soundwave that is reflected by the rearwardly extending panel is substantially in phase with a soundwave from the front panel and acts as a positive wave transformer to convert the rear sound-wave from a negative phase to a positive phase by a process of the sound reflection and hence reduces the required total panel surface area of the loudspeaker.

2. A loudspeaker according to claim 1 wherein the rearwardly extending single panel is offset and substantially perpendicular to the front panel and extends from an edge of the front panel.

3. A loudspeaker according to claim 1 wherein substantially whole of the outside edge of the rearwardly extending panel is curved and defines a substantially constantly changing radius of the side panel with the side panel shaped as a portion of an ellipse or an oval.

4. A loudspeaker according to claim 1 wherein said portion of said outside edge of said rearwardly extending panel is defined by two chords.

5. A loudspeaker according to claim 1 wherein the rearwardly extending panel provides a polar response with cardioid-like characteristics in a forward axis, and a combination of sub-cardioid and dipole polar response in a rearward axis.

6. A loudspeaker according to claim 5 wherein a deep null occurs at the rearwardly extending panel to provide a combination of polar patterns with a complex pseudo-hypercardioid response at above or around 250 Hz and a sub-cardioid/dipole response below or around 250 Hz.

7. A loudspeaker according to claim 1 wherein a plurality of ribs are provided which substantially traverse a surface of the rearwardly-extending side panel with which the same are provided in a non-uniformly spaced arrangement to provide broadband panel resonance reduction, stiffen the panel and improve the rear sound wave phase transforming efficiency by reducing energy losses from internal panel resonances and generate a hemispherical sound wave.

8. A loudspeaker according to claim 1 wherein the rearwardly extending panel includes a pattern of shapes on at least one surface of the same.

9. A loudspeaker according to claim 8 wherein the shapes are recesses or protrusions having a depth of around 0.5-2.0 mm.

10. A loudspeaker according to claim 8 wherein the shapes are denticular.

11. A loudspeaker according to claim 8 wherein the shapes are embossed onto one or more sheets of material which one or more sheets are adhered to a side panel.

12. A loudspeaker according to claim 8 wherein the shapes are provided to generate vortices to prevent premature detachment of air flow and thus the sound wave from the surface of the rearwardly extending panel.

13. A loudspeaker according to claim 1 wherein the front panel is asymmetric and an edge of the front panel defines a substantially constantly changing radius.

14. A loudspeaker according to claim 1 wherein the front panel is shaped as a portion of an ellipse or an oval.

15. A loudspeaker according to claim 1 wherein the front panel is inclined inwardly from a base to top of the loudspeaker and with respect to a vertical axis.

16. A loudspeaker according to claim 1 wherein the rearwardly extending panel is inclined inwardly from a base to top of the loudspeaker with respect to a vertical axis at an angle in the range of 5 to 10 degrees to the vertical axis.

17. An open baffle loudspeaker, said loudspeaker comprising:

a front panel;

one or more drivers mounted in said front panel; and a single panel extending rearwardly from the front panel, said rearwardly-extending panel having an outside edge of the rearwardly extending panel of which at least a portion is curved such that a portion of the soundwave that is reflected by the rearwardly extending panel is substantially in phase with a soundwave from the front panel, and acts as a positive wave transformer to convert the rear sound-wave from a negative phase to a positive phase by a process of the sound reflection and hence reduces the required total panel surface area of the loudspeaker; said front panel and said single panel provided at different angles with respect to the vertical axis of the loudspeaker and a plurality of ribs are provided on said side panel to provide broadband panel resonance reduction, stiffen the panel and improve the rear sound-wave phase transforming efficiency by reducing energy losses from internal panel resonances and generate a hemispherical sound wave.

18. A loudspeaker according to claim 16 wherein said front panel and said rearwardly-extending side panel are provided at different angles with respect to the vertical axis of the loudspeaker.

19. An open baffle loudspeaker comprising:

a front panel;

one or more drivers mounted in said front panel;

a single panel extending rearwardly from the front panel;

said rearwardly-extending panel has an outside edge of which at least a portion is curved such that the portion of the soundwave that is reflected by the rearwardly extending panel is substantially in phase with the soundwave from the front panel, and acts as a positive wave transformer to convert the rear sound-wave from a negative phase to a positive phase by a process of the sound reflection and hence reduces the required total panel surface area of the loudspeaker and;

said front panel and said single panel are provided at different angles with respect to the vertical axis of the loudspeaker.

* * * * *